United States Patent [19]

Quine

[11] 4,301,347

[45] Nov. 17, 1981

[54] FEED SYSTEM FOR MICROWAVE OVEN

[75] Inventor: John P. Quine, Colonie, N.Y.

[73] Assignee: General Electric Company, Schenectady, N.Y.

[21] Appl. No.: 177,989

[22] Filed: Aug. 14, 1980

[51] Int. Cl.[3] ..... H05B 6/74

[52] U.S. Cl. ..... 219/10.55 F; 219/10.55 R

[58] Field of Search ..... 219/10.55 R, 10.55 A, 219/10.55 F, 10.55 E, 10.55 M

[56] References Cited

U.S. PATENT DOCUMENTS

| | | | |
|---|---|---|---|
| 3,210,511 | 10/1965 | Smith | 219/10.55 F |
| 3,373,259 | 3/1968 | Smith | 219/10.55 F |
| 3,819,900 | 6/1974 | Ironfield | 219/10.55 F |
| 3,909,754 | 9/1975 | Chapell | 219/10.55 F X |
| 4,079,221 | 3/1978 | McGillem et al. | 219/10.55 M X |
| 4,099,042 | 7/1978 | Jean et al. | 219/10.55 F |
| 4,107,501 | 8/1978 | Ironfield | 219/10.55 F X |
| 4,144,436 | 3/1979 | Hauck | 219/10.55 F |
| 4,160,144 | 3/1979 | Kashyap et al. | 219/10.55 A |

FOREIGN PATENT DOCUMENTS

| | | | |
|---|---|---|---|
| 47-42579 | 10/1972 | Japan | 219/10.55 F |

OTHER PUBLICATIONS

Simmons, A. J., *Circularly Polarized Slot Radiators,* I.R.E. Trans. on Antennas & Propagation, vol. AP-5, No. 1, Jan. 1957, pp. 31-36.

Helszasn, J., *Passive and Active Microwave Circuits,* John Wiley & Sons, 1978, p. 43.

*Primary Examiner*—Arthur T. Grimley

*Attorney, Agent, or Firm*—Donald R. Campbell; James C. Davis; Marvin Snyder

[57] ABSTRACT

The heating uniformity of a microwave oven is significantly improved by a feed that radiates rotating elliptically polarized electromagnetic waves. A pair of crossed slots in the feed rectangular waveguide has directional characteristics and radiates energy with right-hand and left-hand circular polarization. A variable phase shifter in the waveguide changes the phase of one of the polarizations. Both polarizations interfere in the oven cavity and produce rotating elliptically polarized waves. The circular polarizing element can be a 3-dB hybrid coupler or a turnstile junction.

17 Claims, 8 Drawing Figures

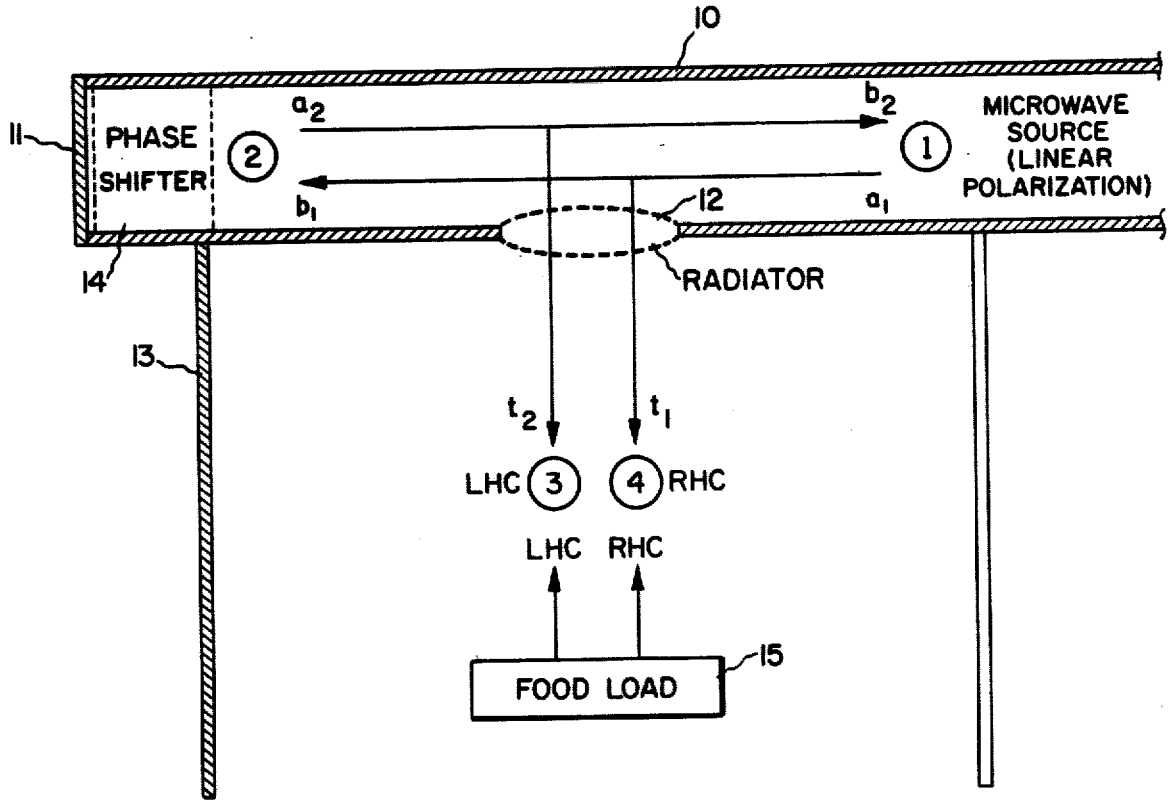
Fig. 1
Fig. 2
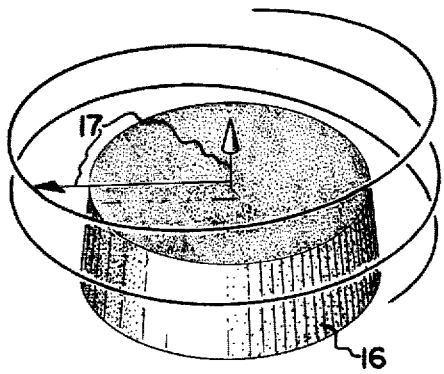

FEED SYSTEM FOR MICROWAVE OVEN

BACKGROUND OF THE INVENTION

This invention relates to microwave ovens and especially to a compact and simple feed system which achieves more uniform cooking of a variety of food loads.

Motional microwave power feeds have been shown to give better cooking performance than stationary linear polarized feeds. However, motional feeds employing rotary joints to directly excite a moving radiator may have problems of reliability. On the other hand, a simple "parasitic" indirectly excited moving radiator, commonly known as a mode stirrer, is more reliable but is not as effective as a directly excited motional feed in producing uniform heating. The reason for its inferior performance is that the common mode stirrer does not rotate the polarization completely around.

The configurations described here represent a new approach which allow the complete rotation of the polarization without the need for a rotary joint. In this way the heating uniformity is improved in a simple way without significant sacrifice in reliability.

SUMMARY OF THE INVENTION

The improved feed radiates into the oven microwave energy with rotating elliptical polarization and employs a circular polarizing element and a phase shifter. The energy is divided between two polarizations and the heating uniformity in the oven cavity is enhanced. This is also true of circular polarization, but circular polarization is difficult or impossible to achieve in the oven. The feed system is comprised of a rectangular waveguide structure to which is coupled a magnetron or other source of linearly polarized electromagnetic waves, and a circular polarizing radiator that possesses directional characteristics such that it radiates right-hand and left-hand circularly polarized waves. A variable phase shifter mounted in the waveguide structure changes the phase of one polarization. The two polarizations interfere and result in rotating elliptically polarized waves.

A simple and compact feed has a single waveguide and a circular polarizing radiator comprised of a pair of slots crossed at 90°. A rotating mechanical phase shifter or an electronic phase shifter is at the other end of the waveguide from the source. Incident power from the magnetron divides between a power which radiates into the oven cavity with one sense circular polarization and a power that passes beyond the slots and is reflected with variable reflective phase by the phase changer. This power returns to the slots and the same fraction radiates out the slots but with the opposite sense circular polarization. Reflected energy from the oven also is fed to the phase shifter, but power requirements for the latter are considerably less than full magnetron power. By changing the phase of one polarization, the major and minor axes of the polarization ellipse are caused to rotate. A circular output waveguide and concentric beam-forming choke improve the radiation patterns of the crossed slots.

A second embodiment utilizes as a 3-dB hybrid coupler having four arms. The source is coupled to a first arm, inclined radiating slots are in the bottom walls of adjacent second and third arms, and the phase shifter is in the fourth arm. Power from the source splits equally and is radiated through the slots with one sense circular polarization. The phase of reflected energy that passes back through the slots is changed and the energy is reradiated and has the opposite sense circular polarization. A third embodiment utilizes a turnstile junction. Power fed from the source is transmitted into the circular output waveguide and has right-hand circular polarization; power reflected from the phase shifter and transmitted into the circular waveguide has left-hand circular polarization (or vice versa). In either case the radiation patterns can be improved by the circular waveguide and choke.

BRIEF DESCRIPTION OF THE DRAWINGS

FIG. 1 is a sketch of a hybrid waveguide junction used to explain the principles of the invention;

FIG. 2 shows a cake load and the two polarizations of a rotating elliptically polarized electromagnetic wave;

DESCRIPTION OF THE PREFERRED EMBODIMENTS

Figure 3:
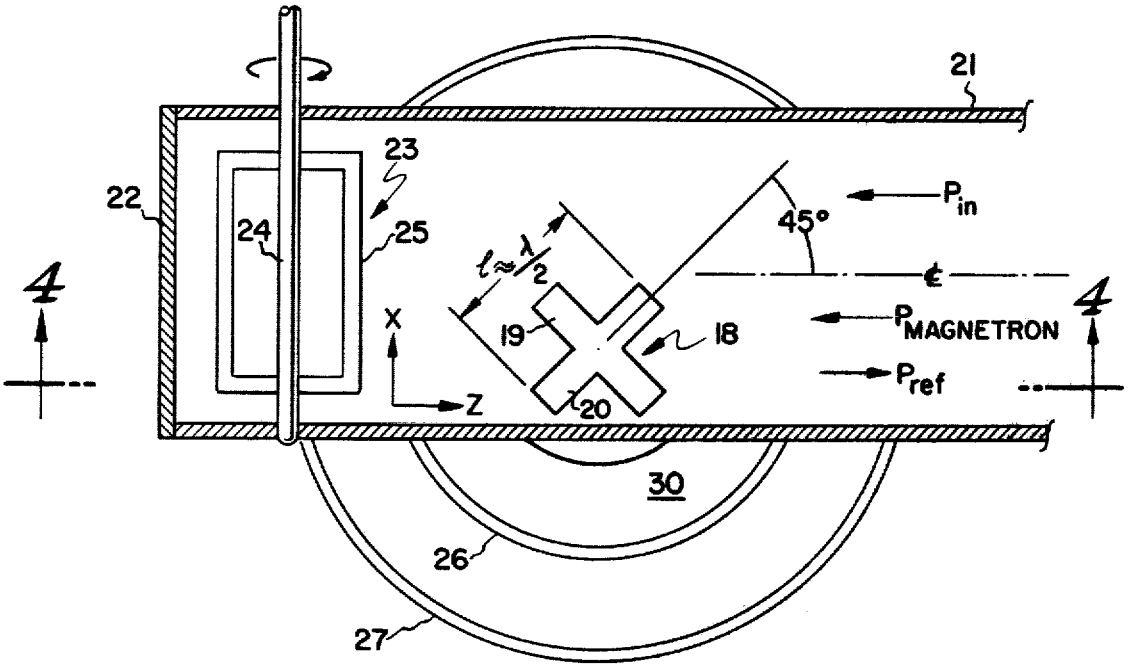
FIG. 3 is a plan view, with the top wall of the feed waveguide removed, of the preferred embodiment of the feed system having a crossed slot circular polarizer.

The concept on which the invention is based is readily understood by reference to FIG. 1, which shows a four port hybrid junction. A source of linearly polarized electromagnetic waves such as a magnetron is coupled to one end of a section of rectangular waveguide 10, and at the other end is a short circuit 11. In the bottom broad wall of feed waveguide 10 is a circular polarizing radiator 12, either an opening or a pair of slots. The energy radiated into another section of rectangular waveguide 13 has left-hand circular polarization (LHC) or right-hand circular polarization (RHC). The four ports are identified on the diagram; the radiator has two ports because the left-hand and right-hand circular polarizations are highly isolated from one another. For the moment it is assumed that phase shifter 14 is not present. The power from the microwave source (port 1) divides between ports 4 and 2; a portion $t_1$ of power $a_1$ is transmitted by radiator 12 and has right-hand circular polarization, and a portion $b_1$ passes beyond the radiator and is reflected. The reflected power from port 2 divides between ports 3 and 1; the portion $t_2$ of reflected power $a_2$ is transmitted by radiator 12 and has left-hand circular polarization and a portion $b_2$ passes beyond the radiator.

There is always a net amount of RHC polarization or LHC polarization in waveguide 13 because the two polarizations are not equal. Thus, both polarizations interfere and produce a standing ellipse. If waveguide 13 is assumed to be an oven cavity, right-hand circularly polarized waves reflected by the food load 15 will be converted to left-hand circularly polarized waves. That part of the reflected energy which passes back through radiator 12 is coupled directly to port 2 and only weakly to port 1. The energy fed to port 2 is again reflected and is hence reradiated as LHC polarization. This situation does not change the fact that the radiated energy has a net RHC polarization or LHC polarization and results in standing elliptical polarization in waveguide 13. In order to rotate the ellipse, it is necessary to change the phase of one of these two polarizations. A variable phase shifter 14 is placed in front of short circuit 11 in feed waveguide 10, and changes the phase of the reflected power and hence of the radiated LHC energy. The net result in the oven is RHC power and LHC power with variable relative phase. This realizes rotating elliptical polarization; the result is equivalent to having a mechanical rotating slot.

Radiated energy with rotating elliptical polarization yields improved heating uniformity in the oven cavity as compared to conventional microwave ovens. The best results with this type of feed system are realized in a nearly rectangular oven cavity. Better cooking performance is realized because, among other reasons, the energy is divided between two polarizations. This is seen in FIG. 2 where a cake load 16 is diagrammed and is heated by a rotating elliptically polarized electromagnetic wave. The two polarization electrical field vectors, at right angles to one another, are indicated at 17. Since the two electric field vectors are rotating, the circumferential heating is relatively good. The division of energy between two polarizations is equivalent to a reduction in order, the two polarizations being equivalent to two modes. On the average, the reduction in order is found to result in better heating uniformity. The feed system for radiating rotating elliptically polarized energy can be fabricated by low cost techniques; the electrical design is not critical and very little quality control testing is required during manufacture. The circular polarizing radiator reduces the effective reflection coefficient experienced by the magnetron. The reduced magnetron reflection makes this oven design much better to withstand the increased reflection occurring when food is cooked in shallow metal containers. These containers results in "mirror effect" which returns essentially the same polarization sense as the incident wave.

Figure 4:
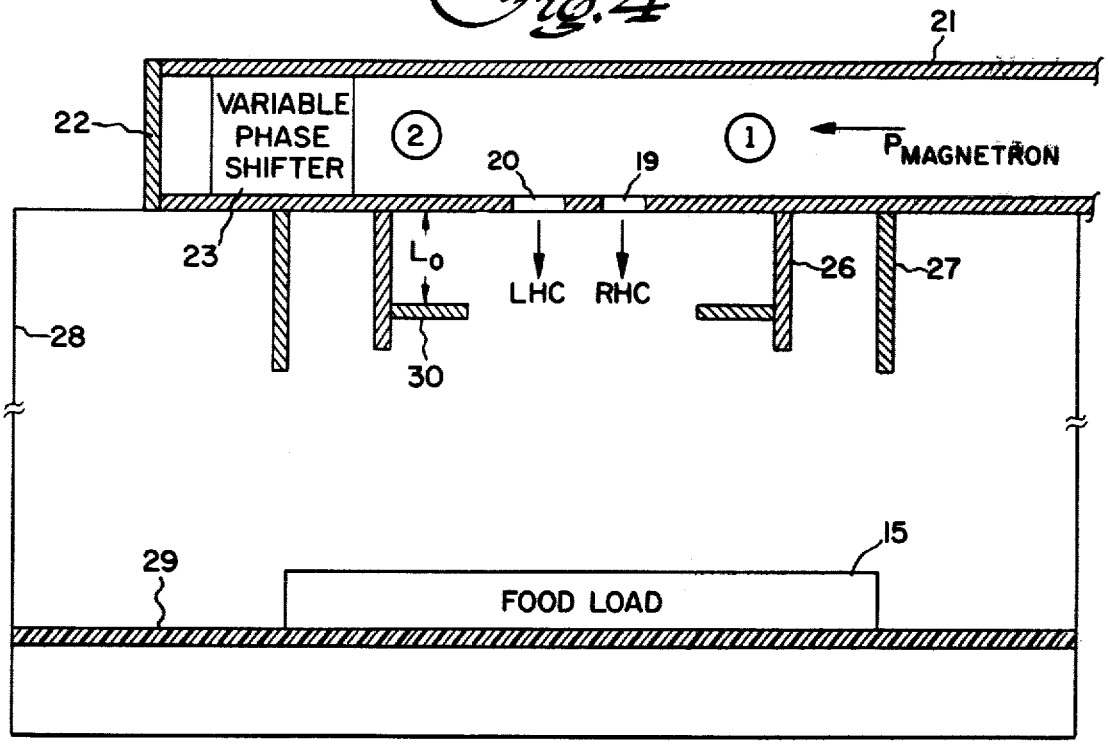
FIG. 4 is a vertical cross section through the microwave oven taken approximately on the line 4—4 in FIG. 3.

Referring to FIGS. 3 and 4, the preferred embodiment of the feed system employs a circular polarizer 18 comprised of a pair of slots 19 and 20 crossed at 90° and contained in a single rectangular waveguide 21. The crossed slots 19 and 20 are cut into the bottom broad wall of waveguide 21 at the proper location to give circular polarization. The center of the crossed slots is located halfway between one narrow wall and the center line of the broad wall of the waveguide. The slots are cut at ±45° to the center line, but other orientations are possible. The length of the slots is approximately one-half wavelength at the source frequency and is selected to give the desired amount of coupling.

When the center of the pair of crossed slots 19 and 20 is at $x=a/4$, where a is the broad wall dimension, the curents $I_x$ and $I_z$ are equal in magnitude and are in phase quadrature. The pair will then radiate circular polarization. This circular polarizer has directional characteristics in that it radiates one sense of circular polarization when excited by a wave travelling in one direction in the waveguide and the opposite sense for a wave travelling in the opposite direction. Conversely, reflected energy from the oven passing back through the slots is coupled strongly in one direction and only weakly in the other. An incident right-hand circularly polarized wave will generate a linearly polarized wave travelling toward one end of the waveguide, while an incident left-hand wave will give a wave in the waveguide travelling toward the other end. The waveguide aperture alternatively may be a small circular hole located at $x=a/4$; the hole is excited by circularly polarized current and radiates a circularly polarized wave. This is further explained and other information given in "Circularly Polarized Slot Radiators," A. J. Simmons, IRE Trans. on Antennas and Propagation, Vol. AP-5, No 1, Jan. 1957, pp. 31–36, the disclosure of which is incorporated herein by reference.

The feed waveguide 21 has a reduced height and is 0.8 inch high by 3.4 inches wide. The microwave source is a magnetron and the frequency is 2.45 GHz. The other end of waveguide 21 is enclosed by a plate 22 and is short circuited, and the variable phase shifter is mounted in the waveguide in front of short circuit 22. Rotary phase changer 23 is comprised of a shaft 24 journalled in the narrow walls of the waveguide and to which is secured a resonant loop or ring 25, and there are blades on the free end of the shaft so that it can be spinned by magnetron cooling air; this is a conventional wind blown mechanical phase shifter. One turn of the ring changes the phase by 180°, and a 180° microwave phase shift results in a90° rotation of the elliptical polarization. The phase changer can also be a conventional electronic phase shifter, either solid state or ferrite. The latter includes a rectangular ferrite slab placed longitudinally along the waveguide center line, and has a current loop for changing the magnetization state and therefore the microwave phase shift. The phase change may be analog or digital. A digital ferrite phase shifter can be used and may be preferred.

Reviewing the operation, the pair of crossed slots 19 and 20 are inherently well matched and have directional characteristics. Incident power, $p_{in}$, from the direction of the magnetron (port 1) produces very little reflected power directly, but divides between a power which radiates directly into the oven with RHC polarization and a power which passes to the waveguide beyond the slots (port 2). The slot dimensions can be adjusted to obtain any desired fraction of the power up to nearly 100 percent radiated as RHC polarization into the oven. The power which passes beyond slots 19 and 20 is reflected with variable reflection phase by rotary phase changer 23. This power, $p_{ref}$, returns to the slots and the same fraction radiates out the slots, but now as LHC polarization. The remaining fraction passes beyond the slots and travels in the direction of the magnetron. As an example, assume that 80 percent of an incident power is radiated by the slots as circular polarization while 20 percent passes beyond the slots. In this case, the RHC power would have a normalized value of 0.8, the LHC power would have a normalized value of $0.2\times0.8=0.16$, while the reflected power would have a normalized power of only 0.04. This reflected power corresponds to a voltage standing wave ratio (VSWR) of 1.5 seen by the magnetron feed waveguide. The phase of the reflected wave varies as a function of phase changer position. The radiated RHC and LHC polarized waves also have varying phase relations depending on the positions of the phase changer. The result is a radiated elliptical polarization with rotating major and minor axes. For the above example, the ratio of major to minor axes would be 2.618 (8.36 dB).

As was mentioned, some of the energy reflected from the food load passes back through crossed slots 19 and 20, and is converted back to linearly polarized waves which propagate through waveguide 21 in the direction of phase shifter 23 or in the direction of the microwave source depending upon the polarization sense of the reflected energy. Reflected LHC power after passing through the slots travels phase changer 23, is reflected, phase shifted, and travels to crossed slots 19 and 20 where a portion ot it is reradiated. Reflected RHC power which passes back through the slots travels in the direction of the magnetron. This circular polarized feed has the important advantage that the motional element, i.e., phase shifter 23 in port 2, is exposed to significantly less than the full magnetron power and, therefore, can be expected to perform more reliably.

Each slot in the pair of crossed slots 19 and 20 have free space radiation patterns with unequal angular width in the E and H planes, the E plane patterns being very broad. These patterns can be made nearly equal and reduced in width by employing a circular output waveguide 26 and concentric beam-forming choke 27, both attached to the bottom wall of feed waveguide 21 with their centers at the center of crossed slots 19 and 20. Analysis shows that the optimum diameter of circular waveguide 26 is on the order of one wavelength. The diameter of choke 27 is not critical and can be, for the example discussed, six to seven inches. The lengths of guide 26 and choke 27 can be different, but they are somewhat less than one quarter wavelength or about one inch. Since the optimum height for feed waveguide 21 is about 0.8 inch, it is seen that the feed system has about a two inch over-all height dimension. A rectangular oven enclosure 28 is illustrated diagrammatically and has an insulating shelf 29 on which the food load is placed.

An optional circular waveguide annular reflector 30 is attached to the inner surface of guide 26, positioned at distance $L_o$, and has an associated reflection coefficient r. It is possible to match an arbitrary food load by adjusting the iris reflector 30 as well as the length of slots 19 and 20. It can be shown by scattering matrix analysis that r and $L_o$ of the optional reflector 30 can be adjusted to give zero coupling to port 2 and zero reflection to port 1, all the power radiated by the feed having perfectly circular polarization. These adjustments can be made for any value of slot coupling. Alternately, r and $L_o$ can be adjusted to cancel out only the aperture reflection of the circular waveguide 26. The power can then be allowed to radiate into a mismatched oven load having net reflection back to the circular waveguide with given effective phase length. The results show that for a phase length equal to a particular resonant value, the slot coupling can be adjusted to give zero reflection back to port 1 with all the power from the magnetron being observed by the load as circular polarization.

The present circular polarized feeds can be compared with a prior art linearly polarized feed employing a conventional mode stirrer on the following basis. These feeds first arrange the power optimally into both polarizations before it is radiated into the oven for a specified typical load. The motional element, phase changer 23, is thus required to interact only with the reflected power in correcting for departures from the specified load. On the other hand, in the case of the conventional feed, the power is radiated into the oven in only a single polarization, and the motional element is required to interact with and scatter the full power into both polarizations.

Figure 5:
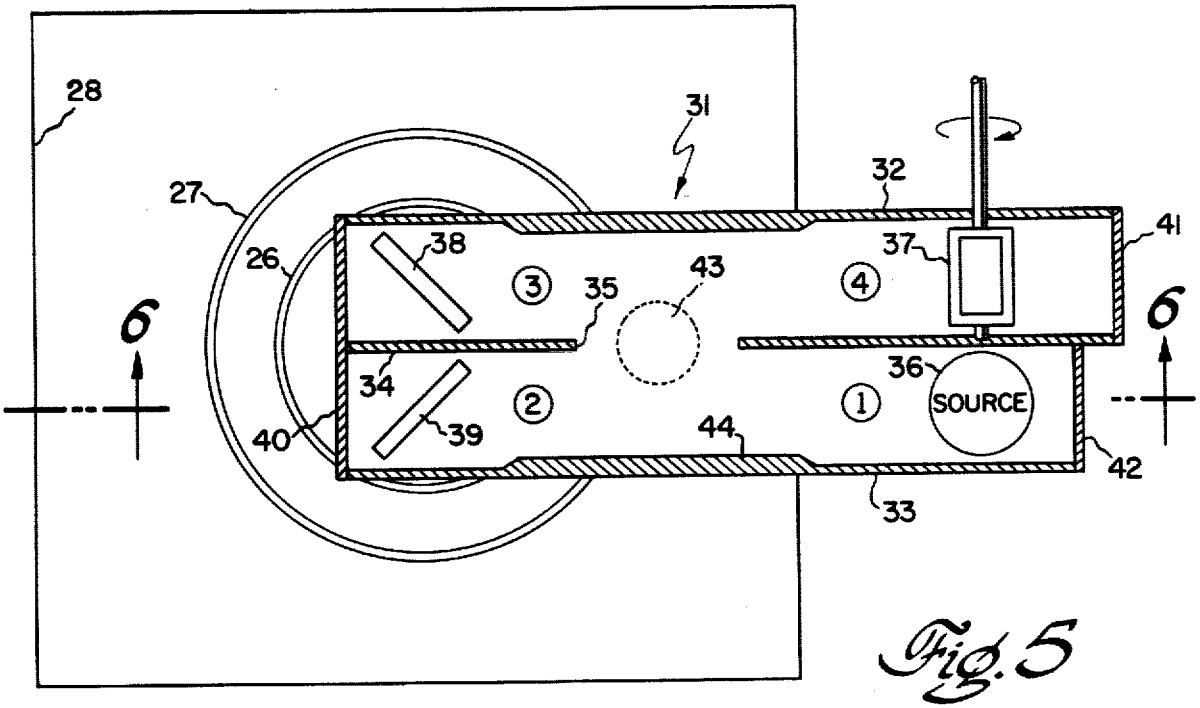
FIG. 5 is a horizontal cross section through another embodiment of the feed system with a 3-dB hybrid coupler, taken just below the top wall of the waveguide.
Figure 6:
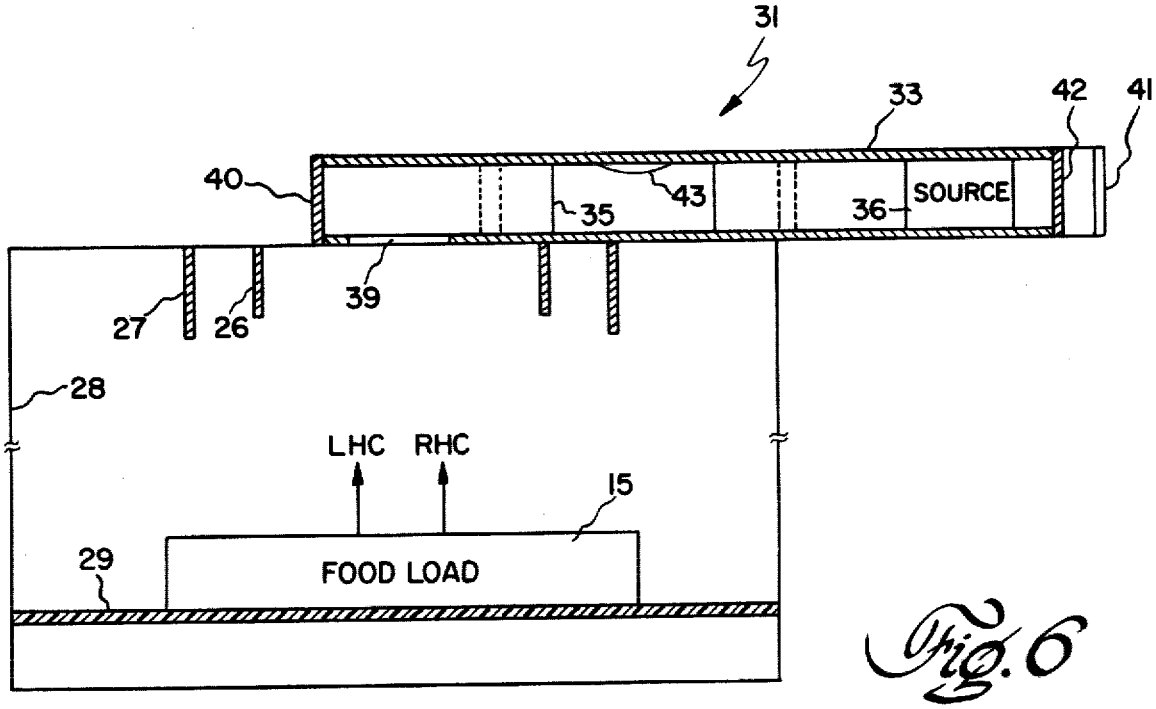
FIG. 6 is a vertical cross section of the oven taken approximately on line 6—6 in FIG. 5.

The second form of the feed system shown in FIGS. 5 and 6 employs a circularpolarizing radiating element embodied in a 3-dB hybrid coupler 31 of standard design which can be fabricated at low cost. The coupler 31 and associated waveguide structure are comprised of two identical rectangular waveguides 32 and 33 that have one narrow wall 34 in common and that are coupled by a rectangular opening 35 in the central wall. The four arms and ports of the hybrid junction are identified by the circled numbers; there is inherently high isolation between ports 1 and 4. A magnetron or other microwave source 36 is coupled to the first arm, and a rotating mechanical phase shifter 37 is mounted between the narrow walls of the fourth arm. The phase shifter, as before, can also be an electronic phase shifter. A pair of mutually perpendicular 45° radiating slots 38 and 39 are cut into the bottom broad walls of the waveguides in the adjacent second and third arms of the hybrid coupler. Short circuit plates 40, 41, and 42 are at the ends of the waveguides, and other conventional features are an odd-mode matching dent 43 or capactive reflector in the top broad wall and side wall width reductions indicated at 44. Guides 32 and 33 are both standard 1.7 inch×3.4 inch waveguide.

The power from magnetron 36 (port 1) enters the hybrid coupler and divides equally to ports 2 and 3 with 90° phase difference between ports 2 and 3. Very little power enters port 4 directly from port 1 as a result of the inherently high isolation between these ports. The power entering ports 2 and 3 is radiated through the inclined slots 38 and 39 which are backed by short circuits 40 and can be adjusted for low reflected power. The currents exciting the slot radiators are equal in magnitude and in phase quadrature. The energy which leaves magnetron 36 and initially radiates from the 45° slots 38 and 39 has right-hand circular polarization. The net energy incident on food load 15 will have RHC polarization, and energy reflected by the food load will be converted to LHC polarization. That part of the reflected energy which passes back through slots 38 and 39 couples directly to port 4 and only weakly to port 1. This energy then is reflected again at port 4 and is radiated back into the oven as LHC polarization which will interfere with the initial RHC polarization to produce elliptical polarization. By changing the phase of the LHC polarization by means of the reflection phase shifter 37 in port 4 of the hybrid coupler, the major and minor axes of the polarization ellipse are caused to rotate. The result is rotating elliptical polarization. Circular output waveguide 26 and beam-forming choke 27 improve the radiation patterns of inclined slots 38 and 39.

It should be noted that reflected energy from the food load or elsewhere which does not couple back into the 45° slots 38 and 39 will be reflected again and be converted from LHC back to RHC polarization before it impinges again on the food load. Thus, any number of multiple reflections between the food load and top wall of the oven will not result in a net change from RHC to LHC power. This configuration has low reflected power levels.

Figure 7:
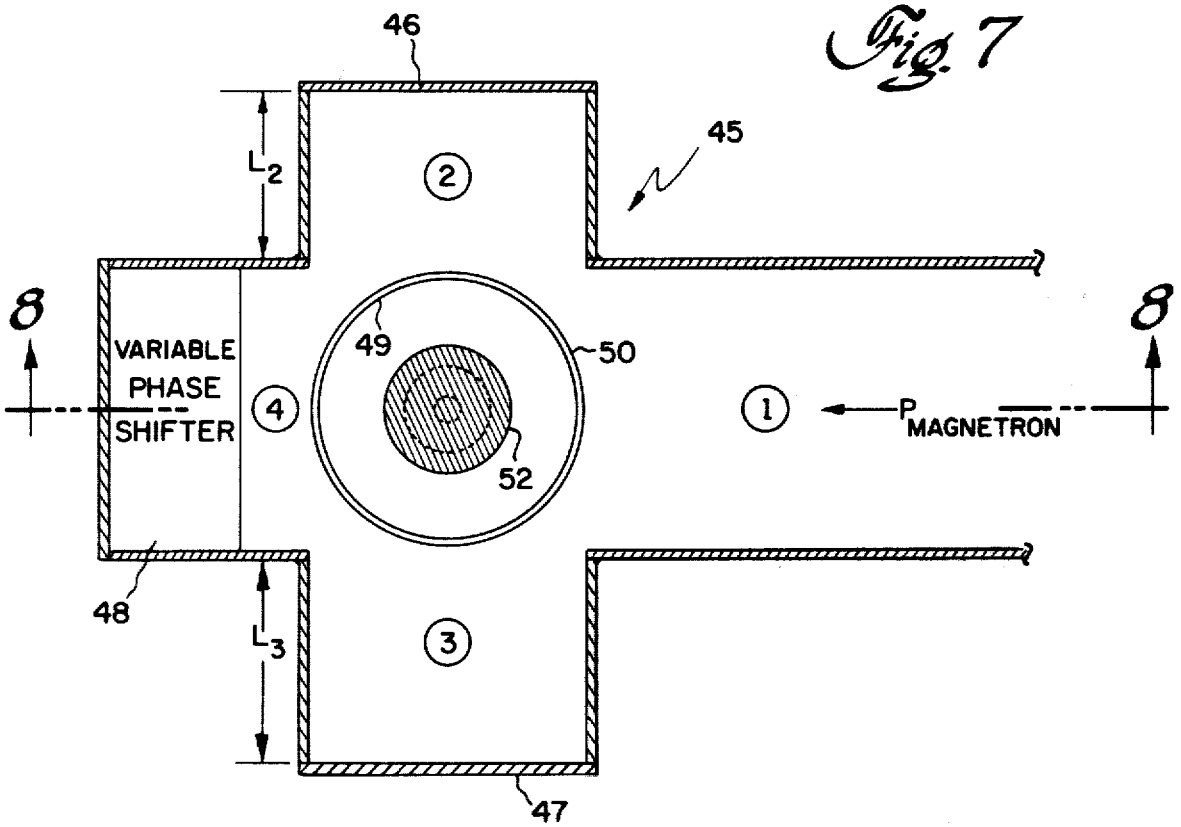
FIG. 7 is a horizontal cross section of a third embodiment in which a turnstile junction is employed to obtain a circular polarized feed.
Figure 8:
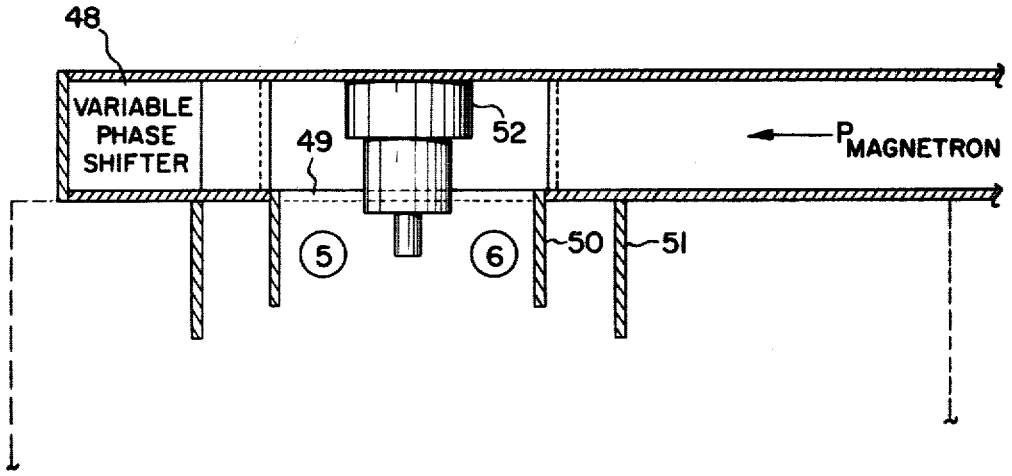
FIG. 8 is a vertical cross section approximately at line 8—8 in FIG. 7.

The third embodiment of the invention illustrated in FIGS. 7 and 8 employs a turnstile junction to obtain a circular polarized feed having certain advantages. The junction is a six port, with four rectangular waveguide ports and two ports in the circular waveguide which radiates into the oven. The turnstile junction 45 is constructed from standard rectangular waveguide. The first arm is coupled to the magnetron or other source, and the opposing second and third arms have different lengths, $L_2$ and $L_3$, and short circuit plates 46 and 47 at their ends. A variable phase shifter 48, either mechanical or electronic, is mounted in the fourth arm which opposes the first arm. At the center of the junction is a central aperture 49 in the bottom wall of the waveguide structure, which is surrounded by a circular output waveguide 50. Beam-forming choke 51 has a larger diameter; circular waveguide 50 and choke 51 improve the radiation pattern. A matching element 52 is screwed to the top wall of the waveguide and projects into the central aperture 49.

The junction is matched by means of the simple element 52 and under these conditions power indicent in any one of the six ports is equally divided among four of the other five ports without reflection in the excited port. High isolation exists between ports 1 and 4 and ports 2 and 3 as well as between the two circular waveguide ports identified in FIG. 8. Short circuits 46 and 47 are positioned in ports 2 and 3 to obtain RHC polarization transmitted into circular waveguide 50 when power is fed into port 1 which is connected to the magnetron, and LHC polarization into the circular waveguide when power enters the junction from port 4, i.e., power reflected from phase shifter 48. The operation of this feed is similar to that described for the crossed slot feed of FIGS. 3 and 4. Reflected energy with LHC polarization passes through circular waveguide 50 and is fed to variable phase shifter 48 which is backed by a short circuit. This power is reflected with variable reflection phase and is radiated back into the oven as LHC polarization which interferes with the RHC polarization to produce rotating elliptical polarization. Some reflected energy after passing through circular waveguide 50 is fed to port 1.

It will be understood that, taking FIG. 1 as an example, ports 1 and 2 may be interchanged, and the source and also the phase shifter and short circuit are interchanged, without altering the result that rotating elliptically polarized waves are radiated into the oven. In this case, energy from the source is radiated into the oven with LHC polarization and energy reflected from the phase shifter is reradiated as RHC polarization. The same is true of the other configurations, that the polarization senses are interchanged.

In conclusion, a circular polarizing radiating device is a hybrid microwave circuit element which possesses directional characteristics. A variable phase shifter is used in conjunction with the circular polarizer to obtain rotating elliptical polarization. True circular polarization for practical purposes is impossible to obtain because of reflections in the oven. The new feed system is simple and compact and can be manufactured economically; improved heating uniformity in the oven results in better cooking performance. This may be called a "polaray" feed.

While the invention has been particularly shown and described with reference to preferred embodiments thereof, it will be understood by those skilled in the art that various changes in form and details may be made therein without departing from the spirit and scope of the invention.

The invention claimed is:

1. In a microwave oven having a source of linearly polarized electromagnetic waves, an oven cavity, and a feed system for radiating microwave energy into said oven cavity, the improvement wherein said feed system comprises:

a rectangular waveguide structure coupled to said source;

a circular polarizing radiator formed in said waveguide structure which possesses directional characteristics such that the radiated energy has right-hand and left-hand circular polarization; and variable phase shifter means for changing the phase of one of said polarizations, interference of both polarizations in said oven cavity resulting in rotating elliptically polarized waves and therefore improved heating uniformity.

2. The microwave oven of claim 1 wherein said circular polarizing radiator comprises a pair of crossed slots in one broad wall of said rectangular waveguide, and wherein said source and said variable phase shifter means and a short circuit are at opposite ends of said rectangular waveguides, and said crossed slots are directly excited by the waves from said source and by waves reflected from said variable phase shifter means.

3. The microwave oven of claim 1 wherein said circular polarizing radiator comprises a pair of inclined slots in two arms of a 3-dB hybrid coupler, and wherein said source is coupled to a third arm and said phase shifter means is in a fourth arm of said hybrid coupler, said third and fourth arms being electrically isolated from one another.

4. The microwave oven of claim 1 wherein said circular polarizing radiator is a turnstile junction with said source and phase shifter means in two opposing arms and short circuits in the other two opposing arms, and a central aperture surrounded by a circular waveguide, whereby power from said source is transmitted to said circular waveguide and has one circular polarization sense, and power reflected from said phase shifter means and transmitted to said circular waveguide has the other circular polarization sense.

5. The microwave oven of claim 1 including a circular output waveguide and concentric beam-forming choke attached to said rectangular waveguide structure surrounding said circularly polarized radiator to improve the radiation patterns thereof.

6. The microwave oven of claim 5 wherein said circular waveguide has an iris reflector secured to its inner surface.

7. The microwave oven of claim 1 wherein said phase shifter means is a rotary mechanical phase shifter or an electronic phase shifter mounted in said waveguide structure which changes the phase of waves that are then reflected to said circular polarizing radiator.

8. A microwave oven having, in combination, a source of linearly polarized electromagnetic waves, an oven cavity, and a feed system for radiating microwave energy into said oven cavity comprising:

a rectangular waveguide coupled at one end to said source;

a variable phase shifter and a short circuit at the other end of said waveguide; and a circular polarizer comprised of an aperture in the broad wall of said rectangular waveguide that radiates right-hand and left-hand circularly polarized waves into said oven cavity, one polarization for waves incident from the direction of said source and the opposite polarization for waves incident from the direction of said phase shifter;

said phase shifter changing the phase of waves propagating toward the other end of said waveguide so that both polarizations of radiated energy interfere in said oven cavity and produce rotating elliptically polarized waves and therefore improved heating uniformity.

9. The microwave oven of claim 8 wherein said circular polarizer aperture is a pair of slots crossed at 90° whose center is halfway between one narrow wall and the center line of the broad wall of said waveguide.

10. The microwave oven of claim 9 wherein said pair of crossed slots have a length of approximately one-half wavelength at the source frequency and are inclined at 45° to the center line of the broad cell.

11. The microwave oven of claim 9 further including a circular output waveguide attached to said rectangular waveguide whose diameter is approximately one wavelength at the source frequency, and a beam-forming choke concentric with said circular waveguide, whereby the radiation patterns of said pair of crossed slots are improved.

12. The microwave oven of claim 11 wherein said circular output waveguide has an annular reflector attached to its inside surface.

13. The microwave oven of claim 11 wherein said phase shifter is a rotary mechanical phase shifter or an electronic ferrite phase shifter.

14. A microwave oven having, in combination, a source of linearly polarized electromagnetic waves, an oven cavity, and a feed system for radiating microwave energy into said oven cavity comprising:

a rectangular waveguide 3-dB hybrid coupler having four arms, said source being coupled to a first arm;

a pair of inclined radiating slots in the bottom walls of adjacent second and third arms which radiate right-hand and left-hand circularly polarized waves into said oven cavity; and a variable phase shifter in a fourth arm of said hybrid coupler for changing the phase of reflected energy that passes back through said inclined slots and is again reflected and reradiated;

said opposite sense circularly polarized waves with varying phase relations interfering in said oven cavity to produce rotating elliptically polarized waves and therefore improved heating uniformity.

15. The microwave oven of claim 14 further including a circular output waveguide and beam-forming choke attached to the bottom wall of said hybrid coupler to improve the radiation patterns of said inclined slots.

16. A microwave oven having, in combination, a source of linearly polarized electromagnetic waves, an oven cavity, and a feed system for radiating microwave energy into said oven cavity comprising: p1 a rectangular waveguide turnstile junction having four arms and a central aperture surrounded by a circular waveguide, said source being coupled to a first arm;

short circuits at the ends of opposing second and third arms and at the end of a fourth arm which is opposite said first arm; and a variable phase shifter in said fourth arm for changing the phase of reflected energy which passes back through said circular waveguide;

said circular waveguide radiating right-hand and left-hand circularly polarized waves with varying phase relations into said oven cavity which interfere to produce rotating elliptically polarized waves and therefore improved heating uniformity.

17. The microwave oven of claim 16 including a concentric beam-forming choke surrounding said circular waveguide to improve the radiation patterns.

* * * * *